US006830393B2

(12) United States Patent
Iwaki et al.

(10) Patent No.: US 6,830,393 B2
(45) Date of Patent: Dec. 14, 2004

(54) PRINTING METHOD, PRINTING DEVICE AND TIME RECORDER

(75) Inventors: Kozo Iwaki, Tokyo (JP); Kenji Tsuchiya, Tokyo (JP)

(73) Assignee: MAX Co., Ltd., Tokyo (JP)

( * ) Notice: Subject to any disclaimer, the term of this patent is extended or adjusted under 35 U.S.C. 154(b) by 0 days.

(21) Appl. No.: 10/108,758

(22) Filed: Mar. 29, 2002

(65) Prior Publication Data

US 2002/0140771 A1 Oct. 3, 2002

(30) Foreign Application Priority Data

Mar. 30, 2001 (JP) ..... P2001-102549

(51) Int. Cl.[7] ..... B41J 2/235
(52) U.S. Cl. ..... 400/124.28; 400/124.11
(58) Field of Search ..... 400/124.11, 124.01, 400/124.28

(56) References Cited

U.S. PATENT DOCUMENTS 4,010,835 A * 3/1977 Martin et al. ..... 400/124.27
4,506,274 A * 3/1985 Coe ..... 346/82
5,048,984 A * 9/1991 Kringe et al. ..... 400/124.02
5,816,720 A * 10/1998 Brannan et al. ..... 400/208
5,846,004 A * 12/1998 Sparshott ..... 400/124.11
5,990,915 A * 11/1999 Tenenbaum et al. ..... 346/82

FOREIGN PATENT DOCUMENTS

| | | |
|---|---|---|
| EP | 0 476 690 A1 | 3/1992 |
| JP | 57 087376 | 5/1982 |
| JP | 62 068767 | 3/1987 |
| JP | 01 178455 | 7/1989 |

OTHER PUBLICATIONS

"DOT Element Arrangement for DOT Matrix Printer," *IBM Technical Disclosure Bulletin*, vol. 31, No. 3, Aug. 1988, pp. 351–354.

* cited by examiner

*Primary Examiner*—Daniel J. Colilla
(74) *Attorney, Agent, or Firm*—Morgan, Lewis & Bockius LLP

(57) ABSTRACT

A printing method for a dot impact type printer including a printer head with a plurality of printing pins arrayed; a moving mechanism for the printer head, and a control unit for controlling printing operation of the printing pins and the moving mechanism of the printer head, characterized in that when characters, symbols or the like are printed according to predetermined print data, the printing pins to be driven for each step movement of the printer head are driven plural times for each step.

14 Claims, 10 Drawing Sheets

(Note) 1, 4, 7 and 2, 3, 5, 6 represent pin numbers.

PRINTING METHOD, PRINTING DEVICE AND TIME RECORDER

BACKGROUND OF THE INVENTION

1. Field of the Invention

The present invention relates to a printing method for a dot-impact type printer, a printing device using the printing method, and a time recorder using the printing device.

2. Description of the Related Art

Conventionally, a time recorder 101 as shown in FIG. 10 is known. The time recorder 101 prints date and time of arrival and departure of the employees on predetermined time cards 103, and manages attending time and leaving time of the employees.

The conventional time recorder 101 employs a dot impact type printer as a device for printing the attending time and leaving time on the time card 103. The dot impact type printer instantaneously presses an ink ribbon disposed close to a sheet of paper as a printing medium with a plurality of minute printing pins to press the ink ribbon against the sheet, whereby ink is transferred onto the sheet.

The printing pins are arrayed on a printer head in a predetermined pattern. Those printing pins are independently driven in the forward direction under electrical control. Accordingly, when a large number of printing pins are simultaneously driven, much electric power simultaneously consumed is required proportional to the number of printing pins to be driven. To enable the supply of the electric power, it is required to use electric power source including the capacitor of large capacitance.

In the conventional printing system, the printing pins to be driven for each step movement (minute distance movement) of the printer head are simultaneously driven. For this reason, a power source using capacitor of large capacitance and electric parts capable of handling the supplying current, and others are required in order to supply an amount of electric power high enough to simultaneously drive the printing pins.

SUMMARY OF THE INVENTION

In view of the above, an object of the present invention is to provide a printing method and a printing device which each reduces an amount of electric power simultaneously consumed, allow the use of cheap electric parts for the power source and other electric circuits, and ameliorate the print quality without reducing the printing speed, by using a pin drive system in which the printing pins are divided into a plurality of groups of printing pins, and those pin groups are driven at different timings, in place of a conventional pin drive system in which all the printing pins are simultaneously driven. An object of the present invention is also to provide a time recorder using the printing device.

In order to solve the above problem, according to a first aspect of the invention, there is provided a printing method for a dot impact type printer including a printer head with a plurality of printing pins arrayed, a moving mechanism for the printer head, and a control unit for controlling printing operation of the printing pins and the moving mechanism for the printer head, wherein, when characters, symbols or the like are printed according to predetermined print data, the printing pins to be driven for each step movement of the printer head are driven plural times for each step.

According to a second aspect of the invention, there is provided a printing device including a dot impact type printer having a printer head with a plurality of printing pins arrayed, a moving mechanism for the printer head, and a control unit for controlling printing operation of the printing pins and the moving mechanism for the printer head, wherein, when characters, symbols or the like are printed according to predetermined print data, the printing pins to be driven for each step movement of the printer head are driven plural times for each step.

Further, according to a third aspect of the present invention, a time recorder includes the printing device according to the second aspect.

Moreover, according to a fourth aspect of the present invention, in a printing method of the first aspect, the moving mechanism for the printer head is substituted by a moving mechanism for moving a printing medium.

Therefore, when characters, symbols or the like are printed according to predetermined print data, the printing pins to be driven for each step movement of the printing medium are driven plural times for each step.

Further, according to a fifth aspect of the present invention, in a printing device of the second aspect, the moving mechanism of the printer head is substituted by a moving mechanism for moving a printing medium Therefore, when characters, symbols or the like are printed according to predetermined print data, the printing pins to be driven for each step movement of the printing medium are driven plural times for each step.

According to a sixth aspect of the present invention, a time recorder includes the printing device according to the fifth aspect.

DETAILED DESCRIPTION OF THE PREFERRED EMBODIMENTS

The preferred embodiments of the present invention will be described with reference to the accompanying drawings.

Figure 1:
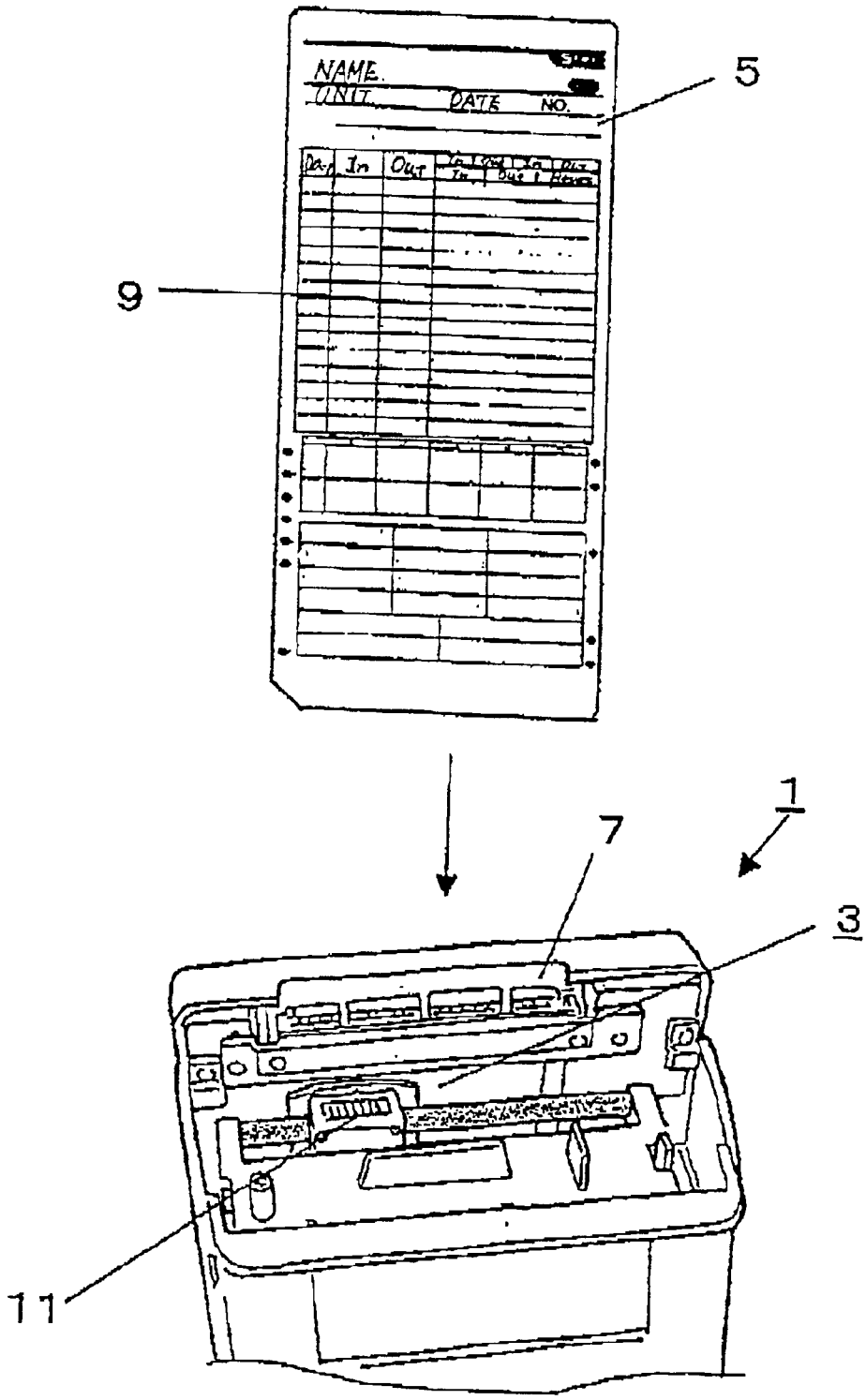
FIG. 1 is a perspective view showing a time recorder as a printing device constructed according to the present invention.
Figure 10:
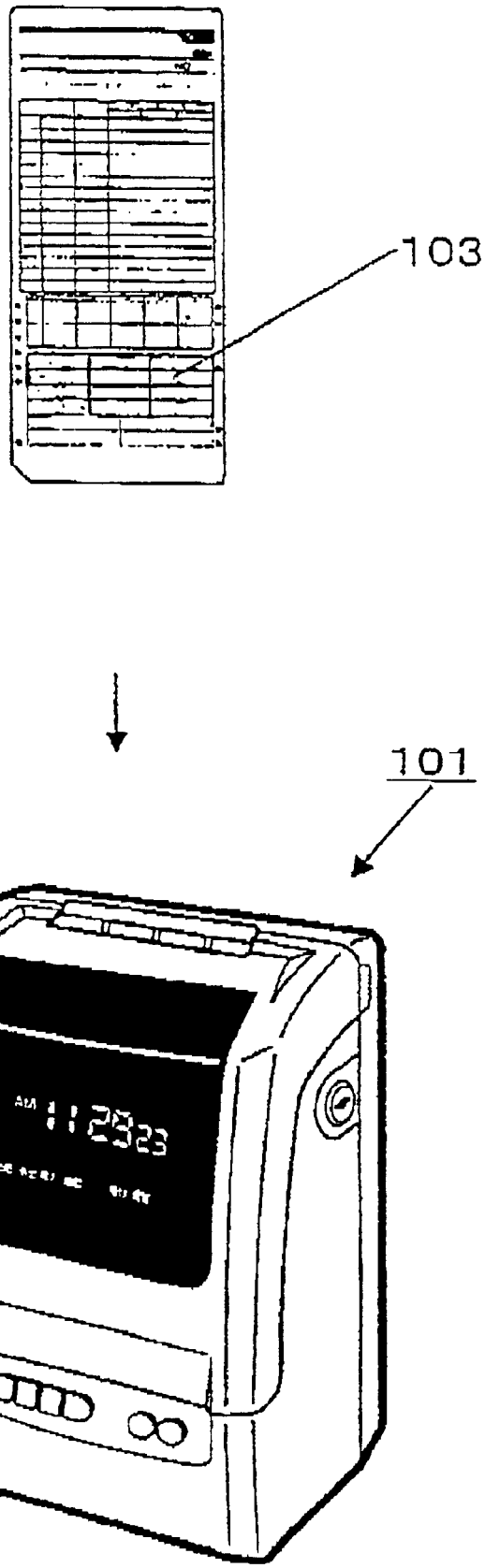
FIG. 10 is a view showing an external appearance of a conventional time recorder.

FIG. 1 is a diagram showing a time recorder 1 incorporating thereinto a printing device constructed according to the present invention. The external appearance of the time recorder 1 is the sane as that of the time recorder in FIG. 10. FIG. 1 illustrates the time recorder 1 in a state that an upper cover of the time recorder 1 is removed so as to allow a dot impact printer 3 as a printing means (referred to as a "printer") to be seen.

A card insertion port 7, through which a time card 5 (referred to as a card) is inserted into the time recorder, is provided in the upper part of the time recorder 1. The card 5 as inserted through the inserting port 7 is held by drive rollers (not shown) provided within the time recorder. Then, it is automatically pulled into the time recorder till it reaches a position where printing columns 9 of the card 5 are confronted with a printer head 11. Thereafter, the printer head 11 prints predetermined time, other characters, symbols and the like on the card 5 while moving along the printing columns 9.

Figure 2A:
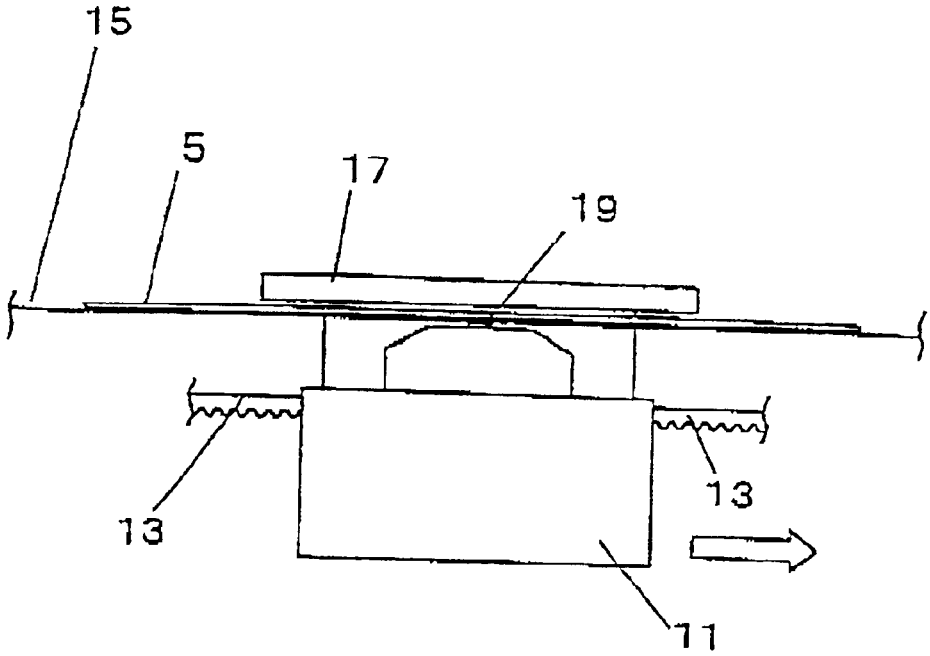
FIGS. 2(*a*) and 2(*b*) are plan views and a perspective views for explaining primal portions of the printing device according to the invention.
Figure 2B:
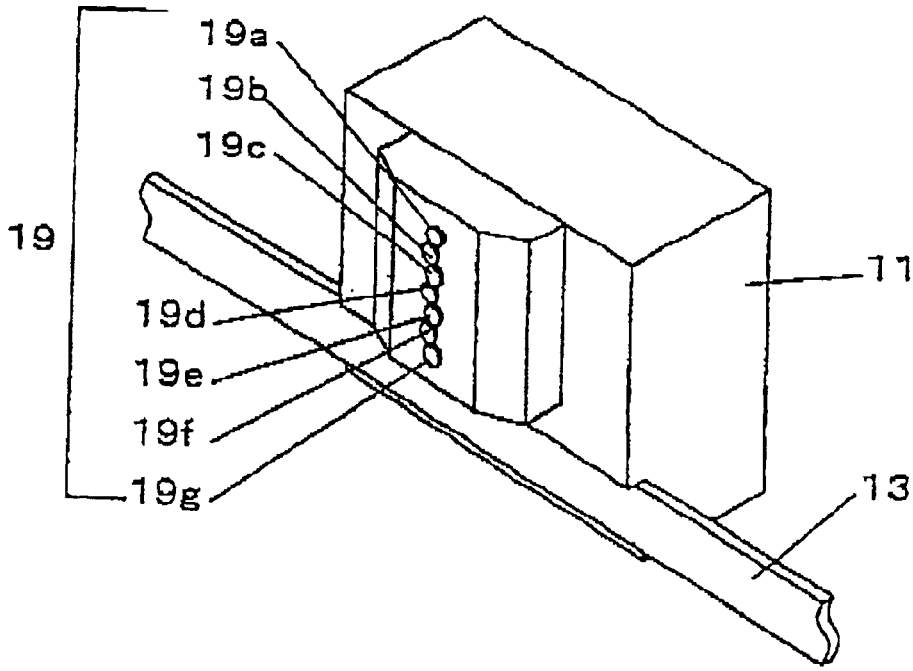

FIGS. 2(*a*) and 2(*b*) are enlarged and schematic views (enlarged view of a key portion) showing the printer head 11. A function of the printer head will be described with reference to the drawing. FIG. 2(*a*) is a plan view showing the printer head 11 when viewed from the top. In the figure, reference numeral 13 indicates a timing belt for moving the printer head 11 horizontally (in the printing direction) by a pulse motor (shown). Reference numeral 15 indicates an ink ribbon, and numeral 17 is a platen functioning as a seat pedestal which is located on the rear side of the card 5 when the printing operation is performed. The platen 17 is coupled to the printer head 11 and moves as the printer head 11 moves, and always functions as the seat pedestal at the time of printing.

FIG. 2(*b*) is a perspective view showing the printer head 11. Numeral 19 indicates a portion containing printing pins, which are a first pin 19*a*, a second pin 19*b*, a third pin 19*c*, a fourth pin 19*d*, a fifth pin 19*e*, a sixth pin 19*f*, and a seventh pin 19*g*, from upside. These pins are arranged in predetermined order.

The printing pins 19 individually are protruded forward and backward by a drive device provided within the printer head 11 in accordance with an order derived from a control unit 25 to be described later. When the printing pins 19 come out, a part of the ink ribbon 15 pressed by the printing pins 19 is thrust against the card 5, which is fixed, in a moment, and ink is transferred thereon, whereby the printing operation is performed.

A known technique is used for the mechanism of the dot impact printer, and its detailed description will be omitted.

Figure 3:
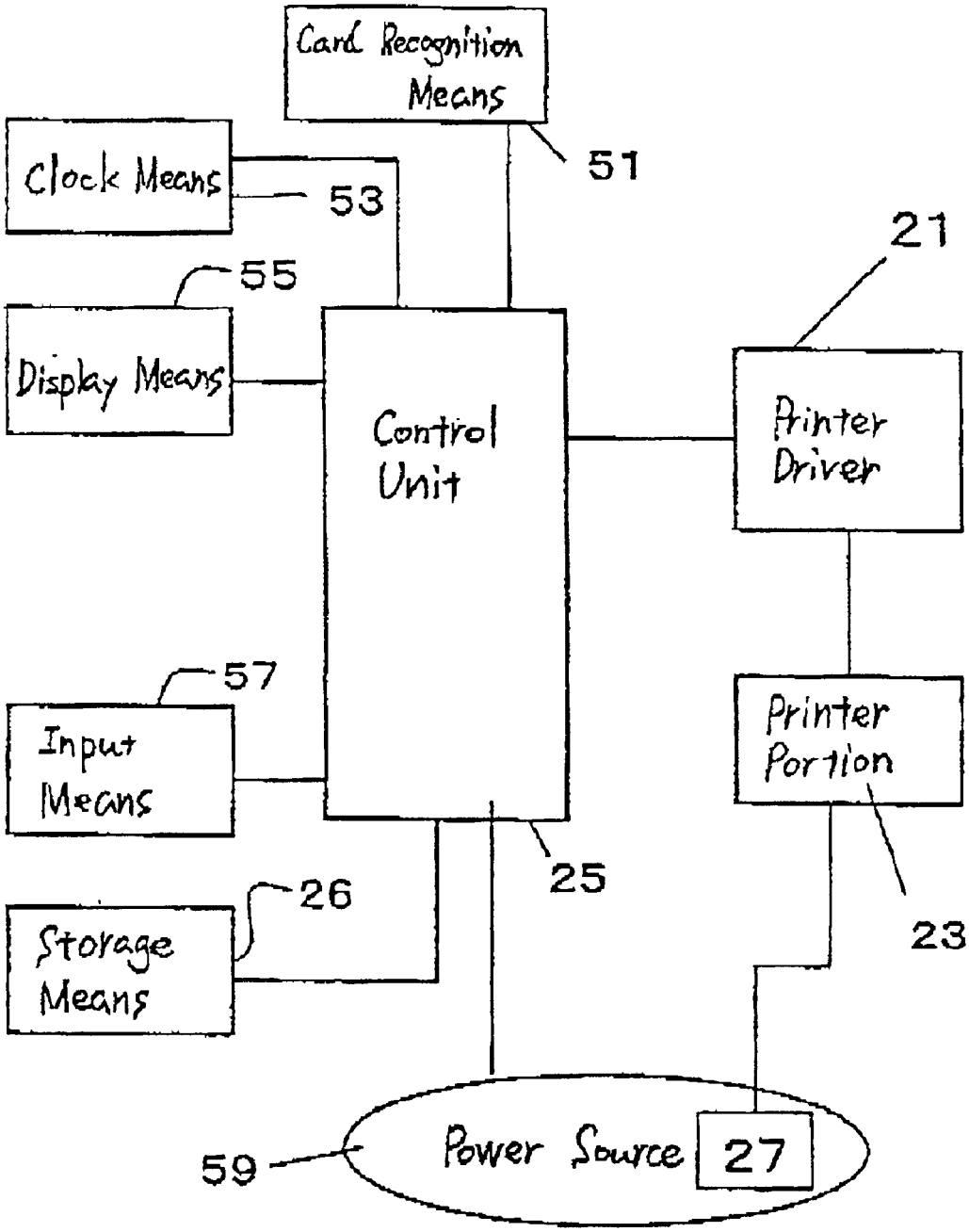
FIG. 3 is a block diagram for explaining electric circuits used in the printing system and the printing device according to the invention.
Figure 4:
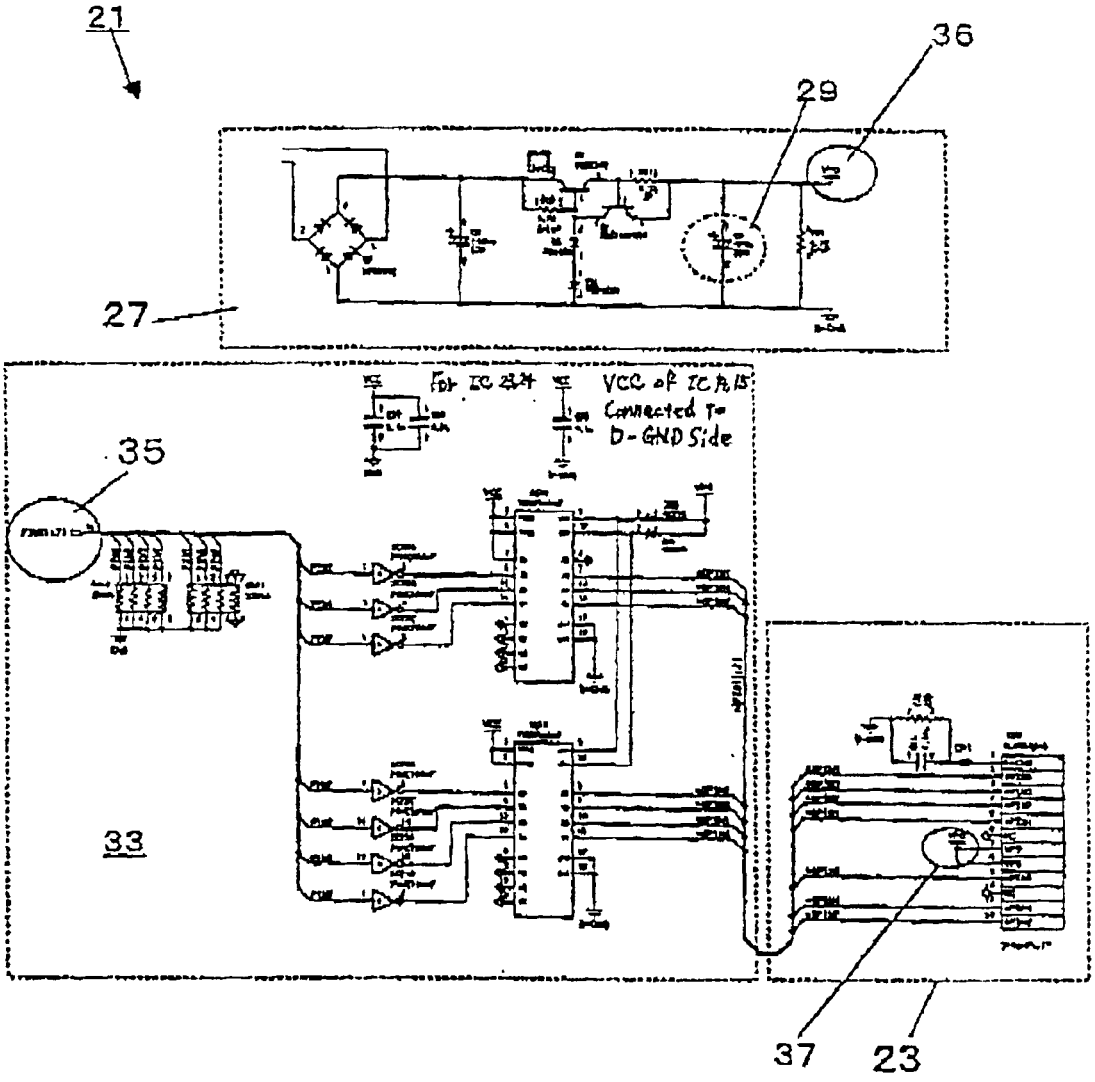
FIG. 4 is a circuit diagram for explaining a part of electric circuit of the printing system and the printing device according to the invention.

FIG. 3 is a block diagram for explaining an electrical arrangement showing an operation of a printer 3, and FIG. 4 is a circuit diagram showing the same.

In FIGS. 3 and 4, numeral 21 designates a circuit of a printer driver, which supplies electric power for moving the printing pins 19 to the printer portion 23. The printer driver circuit 21 operates in accordance with an order derived from the control unit 25 consisting of a CPU, ROM, and other predetermined components. Predetermined electric power is supplied to a printer portion 23 by the printer driver circuit 21.

A block 27 shown in FIG. 4 indicates a power source for supplying power to the printer portion 23. The power source includes a capacitor 29 as a key component, and supplies electric power stored in the capacitor 29 under control of a block 33 to be described later. An output terminal 36 of the power source portion is connected to a supply portion 37 for supplying electric power for driving the printer portion 23.

The block 27 is connected to the control unit 25 through a connector and is controlled by the control unit 25.

The block 33 operates so as to supply electric power fed from the block 27 to the printer portion 23 under control of the control unit 25. The block 33 is controlled with its signal terminal 35 connected to the control unit 25.

The block diagram shown in FIG. 3 shows a configuration of the time recorder 1 in addition to the configuration of the printer portion.

Specifically, reference numeral 51 designates card recognition means for recognizing a card 5 when inserted into the time recorder 1. The time recorder 1 manages attending time and leaving time of the employees in accordance with identification information recognized by the card recognition means 51.

Reference numeral 53 designates clock means used when the time recorder 1 prints attending time and leaving time of the employee on the card 5 or stores the same.

Numeral 55 designates display means for displaying time generated by the clock means 53 or predetermined information.

Numeral 57 designates input means such as a switch or the like for operating the time recorder 1.

Numeral 59 designates a power source which converts a voltage of AC 100 V to a predetermined DC voltage, and supplies electric power to the control circuit, other devices mounted, and the printer portion.

Reference numeral 26 designates storage means, such as a ROM and a RAM. The storage means stores operation programs for the control unit 25, arrival data and departure data for each card 5, and font data for printing, and others.

Seven printing pins 19*a* to 19*g* for the printing pin 19, as described above, are linearly arrayed on the printer head 11 of this embodiment. In this embodiment, those printing pins 19*a* to 19*g*, vertically arranged one on the other, are zigzag arrayed for the purpose of increasing the quality of characters to be printed. More exactly, the printing pins of those vertically arrayed are axially staggered by a distance that is about ¼ as long as the diameter of each printing pin.

Figure 9A:
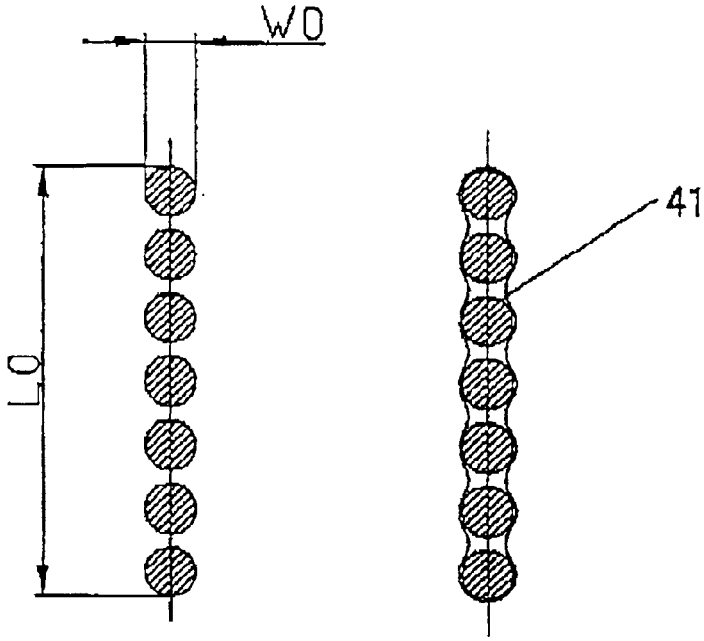
FIGS. 9(*a*) and 9(*b*) are explanatory diagrams for explaining an array of printing pins according to the invention in comparison with an array of conventional printing pin.
Figure 9B:
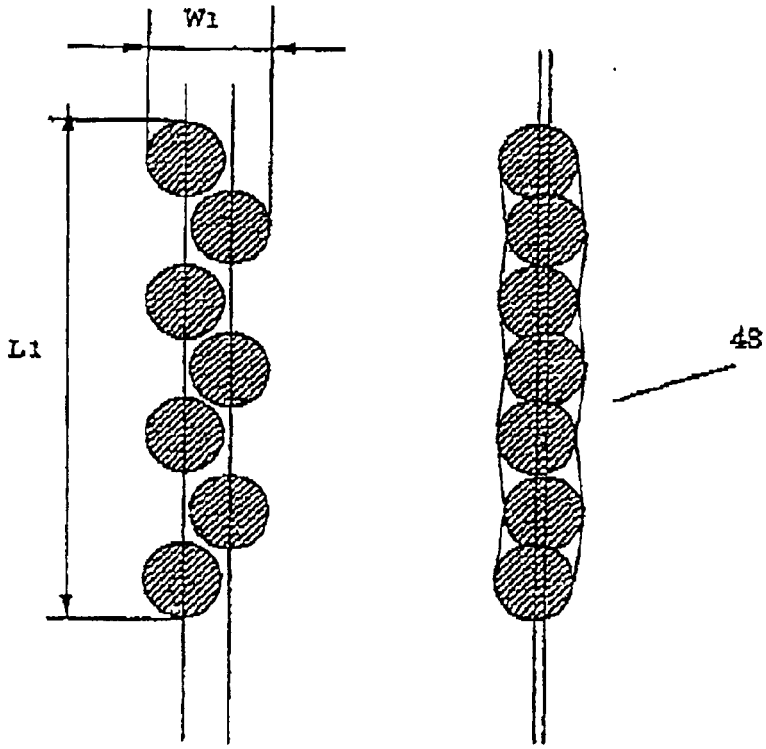

A linear array of printing pins is shown in FIG. 9(*a*) and a zigzag array of printing pins is shown in FIG. 9(*b*). A difference between those printing pin arrays will be described. The printing pins shown in FIGS. 9(*a*) and 9(*b*) are equal in diameter.

A linear array of printing pins is illustrated in the left part of FIG. 9(*a*), and an image actually printed by using the pin array is illustrated in the right part of FIG. 9(*a*). In actual printing, a configuration of the pin as printed is not an actual configuration of the pin, but is somewhat larger than the actual configuration of the pin since the pin presses the printing sheet through the ink ribbon interposed therebetween. Accordingly, an array of actually printed dots is defined by a somewhat continuous contour as indicated by reference numeral 41. When the printing pins are linearly arrayed, a difference between a thick part of the contour line 41 and a thin part of thereof is liable to be large. Its printed image is a thin line.

An array of printing pins illustrated in the left side of FIG. 9(*b*) is the one when the printing pins are not moved forward. An array of dots illustrated in the right part of the figure is the one actually printed. The actually printed dots, as in the previous case, are defined by a somewhat continuous contour line indicated by reference numeral 43.

The staggered arrayed printing pins are provided on the printer head while being spaced from each other. In printing operation, the right and left printing pins are obliquely moved onward and toward the center. Specifically, the right printing pin is protruded to the left side, and the left printing pin is protruded to the right side. In printing, the tips of the printing pins are arranged in an almost straight line on the surface of the printing medium. The printing pins are arrayed staggered to reduce the vertical length of the array of the printing pins, and in printing, the printing pins are arranged into two groups, and one group of printing pins is first operated and the second group of printing pins are then operated. Accordingly, the printing pins do not interfere with each other, and another character may be printed in a state that it is superimposed on a characteristic first printed. By reason of this, the printing is possible with minimized non-print gaps as shown in the left side of FIG. 9(*b*).

When the linear array of printing pins is compared with the zigzag array of printing pins L1 is shorter than L0 (L0>L1) where L0 is a length of the former pin array; and L1 is a length of the latter pin array. Further, W1 is thicker than W0 (W1>W0) where W0 is a width of the former pin array and W1 is a width of the latter pin array. The fact that L1<L0 implies that the printer head containing the pin array of the length L1 is smaller in size than the printer head containing the pin array of the length L0.

Figure 5:
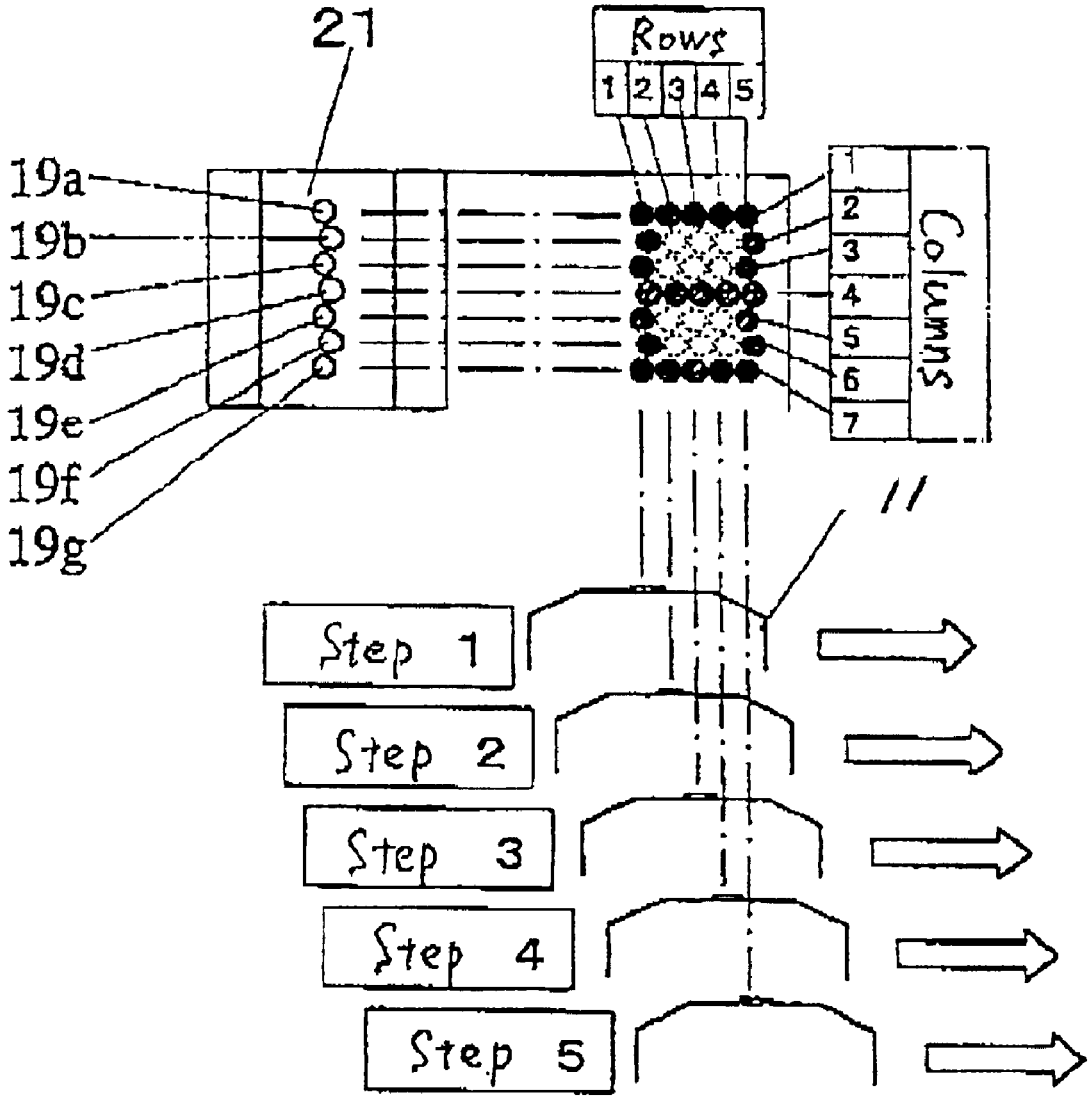
FIG. 5 is an explanatory diagram for explaining operation procedures of printing performed by the printing system and the printing device according to the invention.

Basic operation procedure will now be described when the printer portion 23 is operated under control of the control unit 25 and predetermined characters and the like are printed on the card 5. FIG. 5 is an explanatory diagram for explaining an operation procedure to print typically a character "日" of Kanji (a Chinese character).

A basic printing method employed in the embodiment is such that for the printing, printing pins 19*a* to 19*g* serially arrayed are driven corresponding to the positions (Steps 1 to 5) of the printer head 11 which is moved with the stepwise rotation of a stepping motor (not shown).

In this embodiment, one character consists of a maximum of 35 dots of 5 (rows)×7 (columns) matrix. In order to print a given character, the vertical direction as the column of the matrix corresponds to which printing pin 19 of the 1st to 7th printing pins is driven, and the horizontal direction as the row of the matrix corresponds to the movement of the printer head 11 to the respective positions (Steps 1 to 5).

Specifically, to print the character "日", firstly, when the printer head 11 is positioned at step 1, all the printing pins 19 of the 1st to 7th printing pins are driven to print one vertical line.

Secondly, when the printer head 11 is positioned at Step 2, the 1st, 4th and 7th printing pins 19*a*, 19*d* and 19*g* are driven to print dots at three positions.

Subsequently, also when the printer head 11 is positioned at Steps 3 and 4, the 1st, 4th and 7th printing pins 19*a*, 19*d* and 19*g* are driven to print dots at three positions.

Finally, when the printer head 11 is positioned at Step 5, all the 1st to 7th printing pins 19 are driven to print one vertical line.

Through the operation procedure, the character "日" is finally printed. To print the next character, the printer head and the printing pin 19 are operated in a similar operation procedure to perform the printing.

Figure 6:
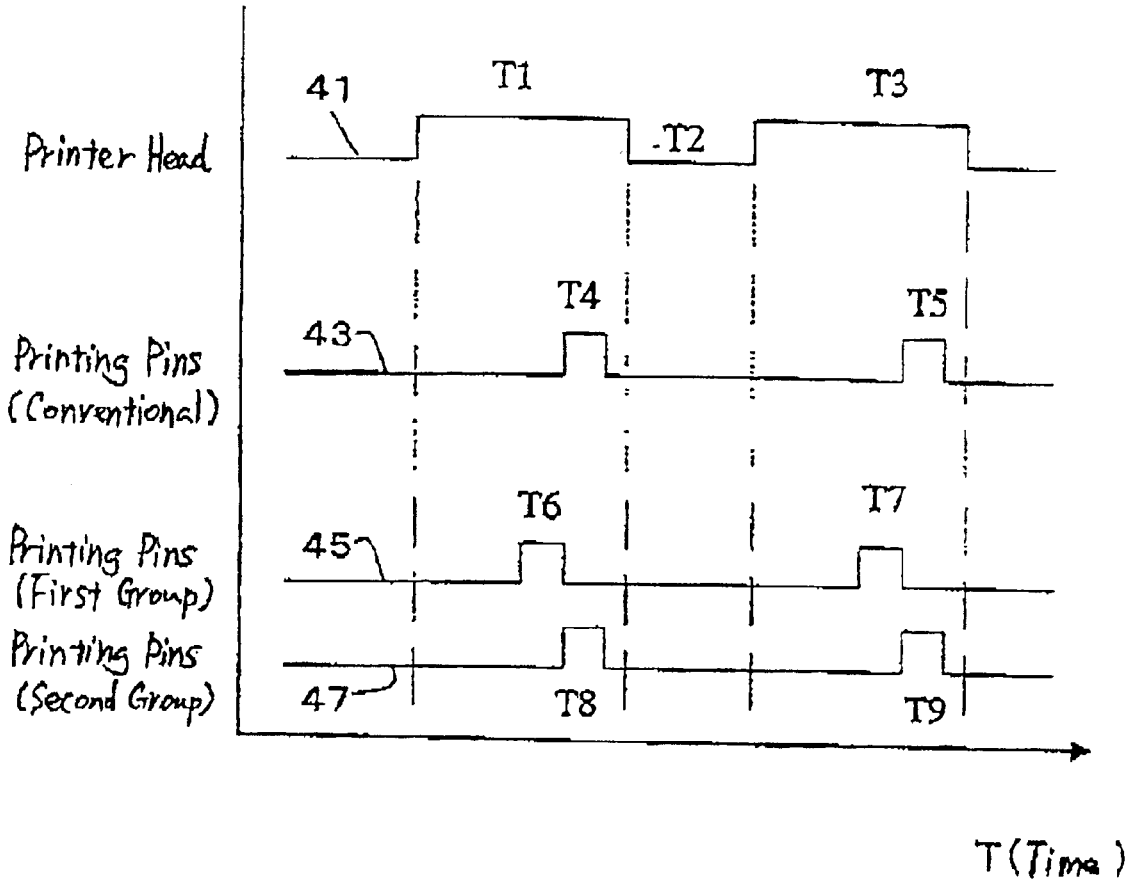
FIG. 6 is a timing chart for explaining the printing system of the invention.

The printing operations mentioned above will be described with reference to FIG. 6. FIG. 6 is a timing chart showing the step movement of the printer head 11 and the operation of the printing pin 19 with respect to time.

A first graph 41 of the first line graphically represents the movement and stop of the printer head 11. In the graph, T1 indicates a time that printer head 11 is stopped at "Step 1" in FIG. 5. T2 indicates a time that the printer head 11 is moved from "Step 1" to "Step 2". T3 indicates a time that the printer head 11 is stopped at "Step 3". The printer head is repeatedly moved and stopped at similar timings, although not illustrated in the graph.

A graph 43 in the second line shows a printing method in a conventional printing device, for comparison with the printer of the present patent application. T4 indicates a state that the printing pins are operated in a state that the printer head 11 is in a T1 state (it is stopped at Step 1). That is, the printer head is printing the first row in FIG. 5.

T5 indicates a state that the printing pins are operated in a state that the printer head 11 is in a T3 state (it is stopped at Step 2). That is, the printer head is printing the second row in FIG. 5. While in FIG. 6, the operations of the printing pins corresponding to Steps 1 and 2 are illustrated, similar operations of the printing pins will be repeated for the other steps.

Graphs 45 and 47 of the third and fourth lines explain a printing method in a printing device, which is an embodiment of the present invention. A graph 45 graphically represents a timing chart to define the operations of three printing pins, 1st, 4th and 7th printing pins 19*a*, 19*d*, 19*d* (those printing pins will be referred to as a first group of printing pins) of all the printing pins 19*a* to 19*g*.

T6 represents a state that the first group of the printing pins are operated in a state that the printer head 11 is in a T1 state. That is, it represents a state that the printer head prints the first row in FIG. 5.

T7 represents a state that the first group of printing pins are operated in a state that the printer head 11 is in a T3 state. That is, it represents a state that the printer head prints the second row in FIG. 5.

A graph 47 in the fourth line graphically represents a timing chart to define the operations of four printing pins, 2nd, 3rd, 5th, and 6th printing pins 19*b*, 19*c*, 19*e*, 19*f* (those printing pins will be referred to as a second group of printing pins) of all the printing pins 19*a* to 19*g*.

T8 represents a state that the second group of printing pins are operated in a state that the printer head 11 is in a T1 state. That is, it represents a state that the printer head prints the first row in FIG. 5.

T9 represents a state that the second group of printing pins are operated in a state that the printer head 11 is in a T3 state. That is, it represents a state that the printer head prints the second row in FIG. 5.

As described above, the printing method and the printing device of this embodiment print characters through the combination of the movement of the printer head 11 and the operation of the printing pin 19.

In the conventional printing method and the unique and inventive printing method of the present invention, the printing operations are carried out in the operating procedure shown in FIG. 5.

The unique and inventive printing method of the present invention is different from the conventional printing method in the following points. When one line is printed, viz., the printing pins 19*a* to 19*g* are operated in a state that the printer head 11 is stopped at a predetermined position, the conventional printing method simultaneously drives all the printing pins to be operated (T4).

On the other hand, in the printing method of the present invention, the printing pins are arranged into two groups, first and second groups, as described in connection with FIG. 6 (T6, T8), and those groups of printing pins are driven at different timings.

In other words, when the first line of the character "日" shown in FIG. 5 is printed, the dots of the first to seventh lines are driven two times, not simultaneously.

Printing operation procedures of the printing device when it prints the character "日" by the printing method of the invention will be described with reference to FIG. 7 (operation table).

In the table, the first horizontal line represents the steps (Steps 1 to 5) of the printer head 11. The second horizontal line represents the operations of the 1st, 4th and 7th printing pins of the first group. The third horizontal line represents the operations of the 2nd, 3rd, 5th and 6th printing pins of the second group. The bottom horizontal line represents the printing at printing columns 9 of the card 5 as a printing medium, which is performed by driving the first and second groups of printing pins.

To print the first line at Step 1, the 1st, 4th, and 7th of the first group of printing pins and the 2nd, 3rd, 5th, and 6th printing pins of the second group are driven to print.

In this case, the printing pins of the first and second groups are driven at different timings, not simultaneously. This technical feature is essential to the present invention. Specifically, in the case of Step 1 as of the graphs 45 and 47 in the third and fourth lines, the printing pins of the first group are first operated at the time indicated by T6, and then the printing pins of the second group are operated at the time indicated by T8. Actually, the times T6 to T9 are those that current is fed to the drive portion of each printing pin 19; however, in the description, those times are used as operation times of the printing pins for ease of explanation.

In the case of Step2, the first group of the printing pins are operated at time T7, and then the second group of printing pins are operated at time T9. In the case of character "日", there is no need of operating the 2nd, 3rd, 5th, and 6th printing pins 19 for the second line of Step 2. Accordingly, no printing operation is performed at this timing although the printing pins are operable.

In the case of Step 3 and 4, as in the case of Step 2, the printing pins of the first group are operated at timings similar to T7. In the case of character "日", there is no need of operating the 2nd, 3rd, 5th, and 6th printing pins 19 for the third and fourth lines of the steps 3 and 4. Accordingly, no printing operation is performed at this timing although the printing pins are operable.

In the case of Step 5, as in the case of Step 1, the printing pins of the first group are first operated at a similar timing. Then, the printing pins of the second group are operated at a timing similar to T8. In this way, the dots of the fifth line are all printed.

Figure 7:
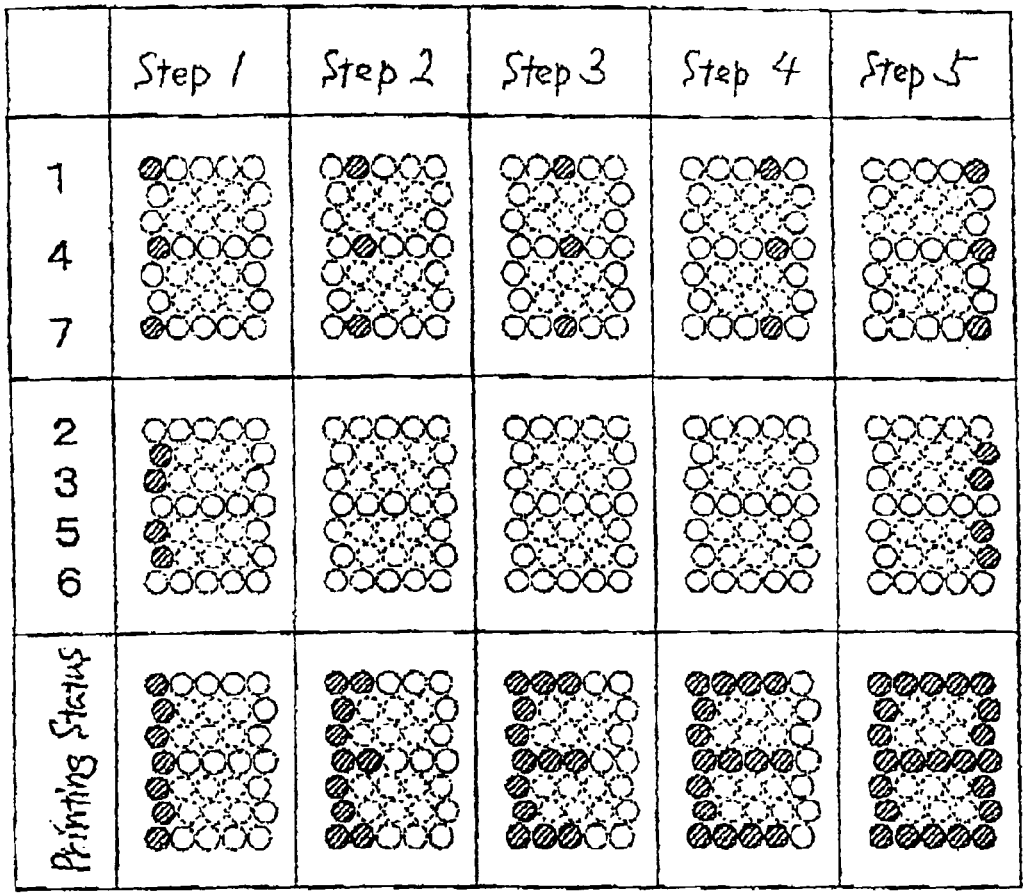
FIG. 7 is a detailed explanatory diagram for explaining printing operation procedures by the printing system according to the invention.

The lowermost horizontal line in the operation table shown in FIG. 7 shows dots printed at the respective steps. As seen from the table, the character "日" is completely printed at Step 5.

When the operations of Steps 1 to 5 are performed in the procedural order, one character, one numeral or one symbol is printed. When the one character is printed, similar operations are repeated for printing the next character.

The printing pins driven at each step are different every character to be printed, as a matter of course. It is readily seen that the case described above is one exemplar.

The printing operations mentioned above are performed under control of a predetermined operation program, and in this case, the circuit blocks 27 and 33 shown in FIG. 4 are driven, and predetermined drive power is fed to the printer portion 23.

The operations of the printing method according to the present invention will be described.

Figure 8A:
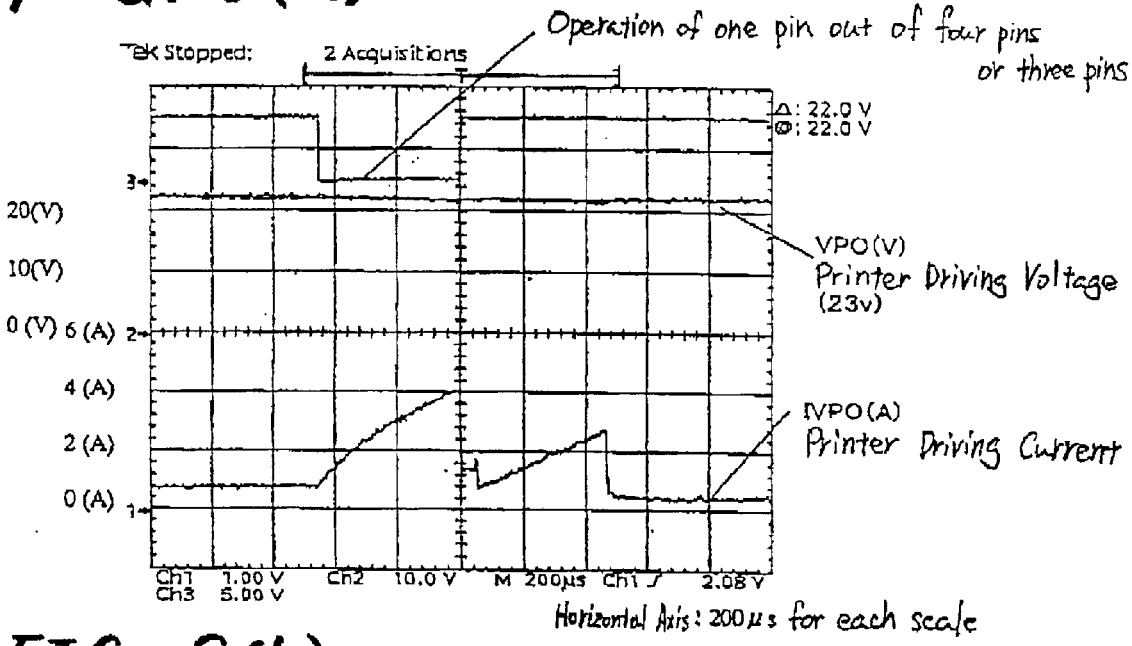
FIGS. 8(*a*) and 8(*b*) are graphs showing the results of measurement of a voltage of a primal portion in the circuit of the printing device according to the invention.
Figure 8B:
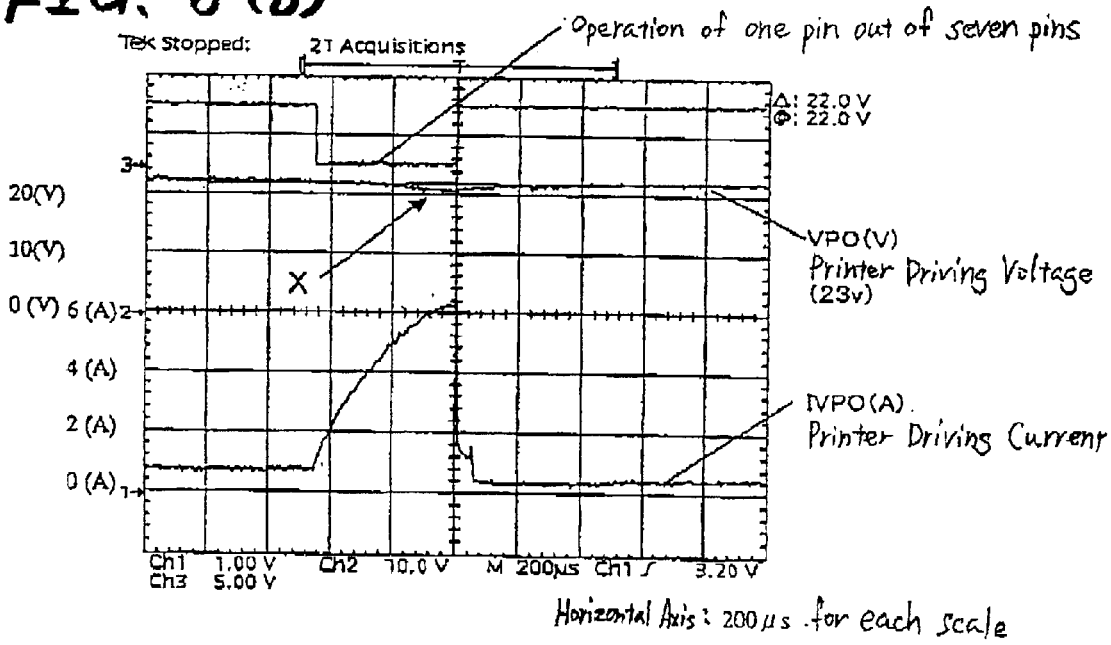

FIGS. 8(*a*) and 8(*b*) are graphs showing voltage and current variations at the supply terminal 37 used for feeding electric power to the printer portion 23 in the circuit diagram of FIG. 4.

FIG. 8(*a*) shows the voltage and current variations at that terminal in this embodiment, and seven printing pins are arranged into two groups, 3 printing pins and 4 printing pins, and those groups of printing pins are driven. In the circuit diagram of FIG. 4 and the graph of FIG. 8(*a*), the printing pins to be driven are arranged into two groups; a group of four pins, 1st, 3rd, 5th, and 7th printing pins, and another group of three pins, 2nd, 4th and 6th printing pins, for ease of explanation. The operation and effect of this case are exactly the same as those of the above-mentioned case (the first group of printing pins (1st, 4th, 7th) and the second group of printing pins (2nd, 3rd, 5th, 6th). The case of FIG. 8(*b*) concerns the conventional art.

In each of the graphs of FIGS. 8(*a*) and 8(*b*), a curve located in the upper part of the graph represents that one printing pin has carried out the printing operation. A curve located in the middle part represents a variation of voltage (VPO) at the supply terminal 37 to which electric power is supplied from the power source 27. A curve located in the lower part represents a variation of current amount (IVPO) fed to the supply terminal 37.

As seen from comparison of the graphs of FIGS. 8(*a*) and 8(*b*), in the case of FIG. 8(*a*), the printing pins are arranged into two groups and those groups of printing pins are driven two times, separately, and two small upward curved profiles appear in the graph. In the case of FIG. 8(*b*), the printing pins are all driven simultaneously, so that one large upward curved profile appears. One division of a scale on the horizontal axis of the graph is 200 $\mu$s (200/1000 sec).

When the printing pins are operated, voltage drops at a point X in the graph of FIG. 8(*b*). This fact indicates that large current is simultaneously consumed, and the capacitor of the power source portion is somewhat insufficient to feed such a large current. When the voltage drop is considerably large, the printing pins do not operate normally, and printing failure possibly occurs.

In the graph of FIG. 8(*a*), no voltage drop occurs because the amount of electric power simultaneously consumed is small. Accordingly, the printing pins normally operate.

In the embodiment mentioned above, the operation of the printing pins is divided into two operations, and those operations are performed at different timings. If required, it may be further divided within the time duration where the printer head is stopped.

In the embodiment, the operation time of the printing pins is selected to be about ¼ or smaller as long as the stopping time of the printer head. Therefore, it is theoretically possible that the printing pins operation is further divided into four operations within the same step.

In the above-mentioned embodiment, the printing pins of the printer head are linearly arrayed. The invention may be applied to a printer having printing pins arrayed in a matrix of plural rows and plural columns.

EXAMPLES

Specific examples of the use of the printing method and the printing device, which are constructed according to the present invention, will be described.

This example is called a time recorder. It is used for managing the attending time and leaving time of the employees by use of a time cards (cards). The dot impact printer (printer) for printing attending time, leaving time, and other characters and symbols has been employed for the time recorder.

A function required for the printer of the time recorder is to print a relatively small amount of characters and the like at a relatively high speed, and not to print a large amount of characters at a time. Accordingly, the functions required for the printing device, unlike the printer for the computer, is that its cost is low, and that the printing of about several centimeters per line is carried out at a relatively high speed.

The printing speed required for the time recorder printer is not high when comparing with the computer printer. For this reason, the printer having the linear array of printing pins, like the conventional printer described in the embodiment, may be employed. If a high speed printing is required, the number of printing pins simultaneously driven must be increased (generally, the printer head whose printing pins are arrayed in a matrix for printing dots of one character is employed). However, in the case of the time recorder, such high function is not required.

As described above, in the printing device of the invention, the capacitor 29 which is used in the power source used for driving the printer may be substituted by a capacitor of low capacity. Accordingly, the cost of the power source is reduced by such. Accordingly, when the printing device of the present invention is used in place of the conventional printer, the resultant time recorder is low in cost.

Specifically, in the conventional power source, the capacitance of capacitor is 1000 $\mu$F, but in the embodiment, it is 470 $\mu$F.

Another example of the present invention will be described.

In the printing device mentioned above, the printer head is moved to the printing medium for printing. In this embodiment, the printing medium is moved relative to the fixed printer head. With this mechanism, the printing operation is performed as in the above-mentioned printing device.

In this embodiment, the mechanism for moving the printing medium is provided instead of the printing method for moving the printer head, although detailed description of the moving mechanism is omitted. The moving mechanism for a printing medium uses rollers which rotate while holding a sheet, e.g., card, therebetween.

The example already described or this embodiment may be selected depending on the specifications of an apparatus incorporating the printing device thereinto.

The effects of the invention will be described. In the printing method according to the present invention, the printing pins for printing operation are arranged into two or more number of groups, and those groups of printing pins are operated at different timings. In other words, those printing pins are not simultaneously operated. Accordingly, the electric power supplied to the printer portion is reduced in amount when comparing with the case where the printing pins are simultaneously driven. Accordingly, the capacity of the capacitor used for power supply may be reduced.

This fact implies that the capacitor of large capacity, which is conventionally used, may be substituted by the capacitor of low price. Accordingly, the power source for driving the printer may be constructed at low price.

The amount of electric power consumed by the printer head remains unchanged. However, the amount of electric power simultaneously consumed is small. Then, the problem of the voltage drop caused by simultaneous feeding of the large current is solved. Accordingly, the operation failure of the printing pins does not occur. In addition to those effect, the deterioration of the printing quality is prevented.

Further, the printing device of the invention, when employing the printing method according to the present invention, may use a power source at low price when compared with the conventional printer having the comparable functions.

Moreover, if the low price printing device is applied to the time recorder, the resultant time recorder is also low in cost.

What is claimed is:

1. A printing method for a dot impact type printer including a printer head with a plurality of printing pins arrayed, a moving mechanism for moving said printer head relative to a printing medium, and a control unit for controlling printing operation of said printing pins and said moving mechanism, said printing method comprising the steps of:

moving the printing head at a plurality of stopping positions for each character, symbol, or the like to be printed, by means of the moving mechanism;

selecting one or more printing pins at each stopping position; and driving the selected printing pins against the printing medium according to a predetermined print data that depends on the character, symbol or the like to be printed.

2. The printing method according to claim 1, wherein said step of driving said printing pins is conducted for each step movement of said printer head.

3. The printing method according to claim 1, wherein, in said step of driving, said printing pins are driven and said printing medium is fixed.

4. The printing method according to claim 1, wherein, in said step of driving, said printing pins are fixed and said printing medium is moved.

5. A printing device of a dot impact type printer, comprising;

a printer head with a plurality of arrayed printing pins;

a moving mechanism that moves said printer head relative to a printing medium; and a control unit that determines a time for driving the printing pins and a time for the moving mechanism to move the printer head, thereby controlling printing operation of said printing pins and said moving mechanism, wherein, for each character, symbol, or the like to be printed, at the time for driving the printing pins and the time for moving the printing head determined by the control unit, the moving mechanism moves the printing head at a plurality of stopping positions, and at each such position the one or more selected printing pins are driven against the printing medium according to a predetermined print data that depends on the character, symbol or the like to be printed.

6. The printing device according to claim 5, wherein the moving mechanism moves the printer head stepwise into stepping positions, and the time for driving said printing pins depends on the stepping positions of said printer head.

7. The printing device according to claim 5, wherein the control unit drives said printing pins, and the moving mechanism holds said printing medium in a fixed position when the character, the symbol or the like is printed.

8. A time recorder for managing and printing time data, comprising;

a printing medium for printing time data;

a printer head with a plurality of arrayed printing pins;

a moving mechanism that moves the printing medium relative to the printer head; and a control unit that determines a time for driving the printing pins and a time for the moving mechanism to move the printing medium, thereby controlling printing operation of said printing pins and said moving mechanism, wherein, for each character, symbol, or the like to be printed, at the time for driving the printing pins and the time for moving the printing head determined by the control unit, the moving mechanism moves the printing head at a plurality of stopping positions, and at each such position the one or more selected printing pins are driven against the printing medium according to a predetermined print data that depends on the character, symbol or the like to be printed.

9. The time recorder according to claim 8, wherein the moving mechanism moves the printing medium stepwise into stepping positions, and the time for driving said printing pins depends on the stepping positions of the printing medium.

10. The time recorder according to claim 8, wherein the control unit drives the printing pins, and the moving mechanism holds said printing medium in a fixed position when the character, the symbol or the like is printed.

11. A time recorder for managing and printing time data, comprising;

a printing medium for printing time data;

a printer head with a plurality of arrayed printing pins;

a moving mechanism that moves the printing medium relative to the printer head; and a control unit that determines a time for driving the printing pins and a time for the moving mechanism to move the printing medium, thereby controlling printing operation of said printing pins and said moving mechanism, wherein said printing pins are driven relative to the printing medium for a plurality of times when at least one character, symbol or the like is printed according to predetermined print data, and wherein the control unit holds said printing pins in a fixed position, and the moving mechanism moves said printing medium when the character, the symbol or the like is printed.

12. A printing device of a dot impact type printer, comprising;

a printer head;

a plurality of printing pins arranged in an arrayed pattern along a first direction on a surface of the printing head, the printing pins being independently movable in a second direction by a drive device, and the printing pins thrusting against a printing medium when driven out of the printing head;

a moving mechanism for moving said printer head relative to the printing medium in a third direction; and a control unit that determines moving times and stopping times for said moving mechanism, and that selects one or more of the printer pins to be driven by the drive device at each stopping time, wherein, for each character, symbol, or the like to be printed, at the moving times and stopping times determined by the control unit, the moving mechanism moves the printing head at a plurality of stopping positions, and at each such position the one or more selected printing pins are driven against the printing medium according to a predetermined print data that depends on the character, symbol or the like to be printed.

13. The printing device of a dot impact type printer according to claim 12, wherein the character, symbol, or the like to be printed consists of a plurality of dots located on a matrix of m columns by n rows, each row being oriented in the third direction, each column of dots oriented in the first direction, and wherein the stopping positions of the printing head correspond to the columns of the matrix of dots.

14. A printing device of a dot impact type printer, comprising:

a printer head;

a plurality of printing pins arranged in an arrayed pattern along a first direction on a surface of the printing head, the printing pins being independently movable in a second direction by a drive device, and the printing pins thrusting against a printing medium when driven out of the printing head;

a moving mechanism for moving said printer head relative to the printing medium in a third direction; and a control unit that determines moving times and stopping times for said moving mechanism, and that selects one or more of the printer heads to be driven by the drive device at each stopping time, wherein, for each character, symbol, or the like to be printed, the moving mechanism moves the printing head at a plurality of stopping positions, and at each such position the one or more selected printing pins are driven against the printing medium according to a predetermined print data that depends on the character, symbol or the like to be printed, wherein the character, symbol, or the like to be printed consists of a plurality of dots located on a matrix of m columns by n rows, each row being oriented in the third direction, each column of dots oriented in the first direction, and wherein the stopping positions of the printing head correspond to the columns of the matrix of dots, and wherein the printing pins are partitioned into at least a first group and a second group of printing pins, and wherein, at one of the stopping positions of the printing head, the drive device drives the first group of printing pins at a first time period, and drives the second group of printing pins at a next time period, thereby driving the first and second groups of pins at different time periods.

* * * * *